US007220234B2

(12) United States Patent
Breneman

(10) Patent No.: US 7,220,234 B2
(45) Date of Patent: May 22, 2007

(54) EXERCISER DEVICE FOR LOWER LEGS

(76) Inventor: James C. Breneman, 10571 Miller Dr., Galesburg, MI (US) 49053

( * ) Notice: Subject to any disclaimer, the term of this patent is extended or adjusted under 35 U.S.C. 154(b) by 444 days.

(21) Appl. No.: 10/744,451

(22) Filed: Dec. 23, 2003

(65) Prior Publication Data

US 2004/0176219 A1 Sep. 9, 2004

Related U.S. Application Data

(60) Provisional application No. 60/436,404, filed on Dec. 26, 2002.

(51) Int. Cl.
*A61H 1/02* (2006.01)

(52) U.S. Cl. ..... 601/5; 601/27; 601/32; 482/80

(58) Field of Classification Search ..... 601/5, 601/23, 27, 29, 31–36, 84, 86, 87, 89–93, 601/97, 98, 101, 104; 482/57, 79, 80, 904, 482/906

See application file for complete search history.

(56) References Cited

U.S. PATENT DOCUMENTS 2,202,187 A * 5/1940 Chalette ..... 601/32
3,370,584 A 2/1968 Girten
3,713,438 A * 1/1973 Knutsen ..... 601/35
3,751,033 A * 8/1973 Rosenthal ..... 482/60
3,917,261 A * 11/1975 Small et al. ..... 601/29
4,185,622 A * 1/1980 Swenson ..... 601/27
4,628,909 A * 12/1986 Tietsworth ..... 601/35
5,170,776 A * 12/1992 Pecheux ..... 601/29
5,267,924 A * 12/1993 Miller et al. ..... 601/27
6,758,825 B1 * 7/2004 Mathew ..... 601/5
2003/0036462 A1 * 2/2003 Ravikumar et al. ..... 482/51

* cited by examiner

*Primary Examiner*—Quang D. Thanh
(74) *Attorney, Agent, or Firm*—Price, Heneveld, Cooper, DeWitt & Litton, LLP

(57) ABSTRACT

An exercise device for exercising the lower legs of airline passengers. The device includes a support structure, and a foot platform that is movably mounted to the support structure. A motor is interconnected with the foot platform by a crank arrangement to provide powered reciprocation of the foot platform. The exercise device has a low profile, enabling the exercise device to fit under an airline seat. Elastic straps or other suitable restraints are provided on the moving foot platform to hold a passenger's feet in place. The ankle motion resulting from the reciprocation of the foot support stretches and/or relaxes the lower leg muscles to alleviate blood stasis of the lower leg.

6 Claims, 1 Drawing Sheet

EXERCISER DEVICE FOR LOWER LEGS

CROSS-REFERENCE TO RELATED APPLICATIONS

This application claims the benefit of U.S. Provisional Application No. 60/436,404, filed on Dec. 26, 2002, the entire contents of which are incorporated by reference.

BACKGROUND OF THE INVENTION

During airline travel, passengers may be required to sit in a seat for extended periods of time, particularly on long-haul flights. Due to the limited space available, passengers are often restricted unable to move their legs, such that blood circulation in the lower legs may be quite low. This may result in blood clots in the legs, leading to deep vein thrombosis (DVT).

SUMMARY OF THE INVENTION

One aspect of the present invention is an exercise device for exercising the lower legs of airline passengers. The device includes a support structure, and a foot platform that is movably mounted to the support structure. A motor is interconnected with the foot platform by a crank arrangement to provide powered reciprocation of the foot platform. The exercise device has a low profile, enabling the exercise device to fit under an airline seat. Elastic straps or other suitable restraints are provided on the moving foot platform to hold a passenger's feet in place. The ankle motion resulting from the reciprocation of the foot support stretches and/or relaxes the lower leg muscles to alleviate blood stasis of the lower leg.

These and other features, advantages, and objects of the present invention will be further understood and appreciated by those skilled in the art by reference to the following specification, claims, and appended drawings.

BRIEF DESCRIPTION OF THE DRAWINGS

FIG. 1.

DETAILED DESCRIPTION OF PREFERRED EMBODIMENT

Figure 1:
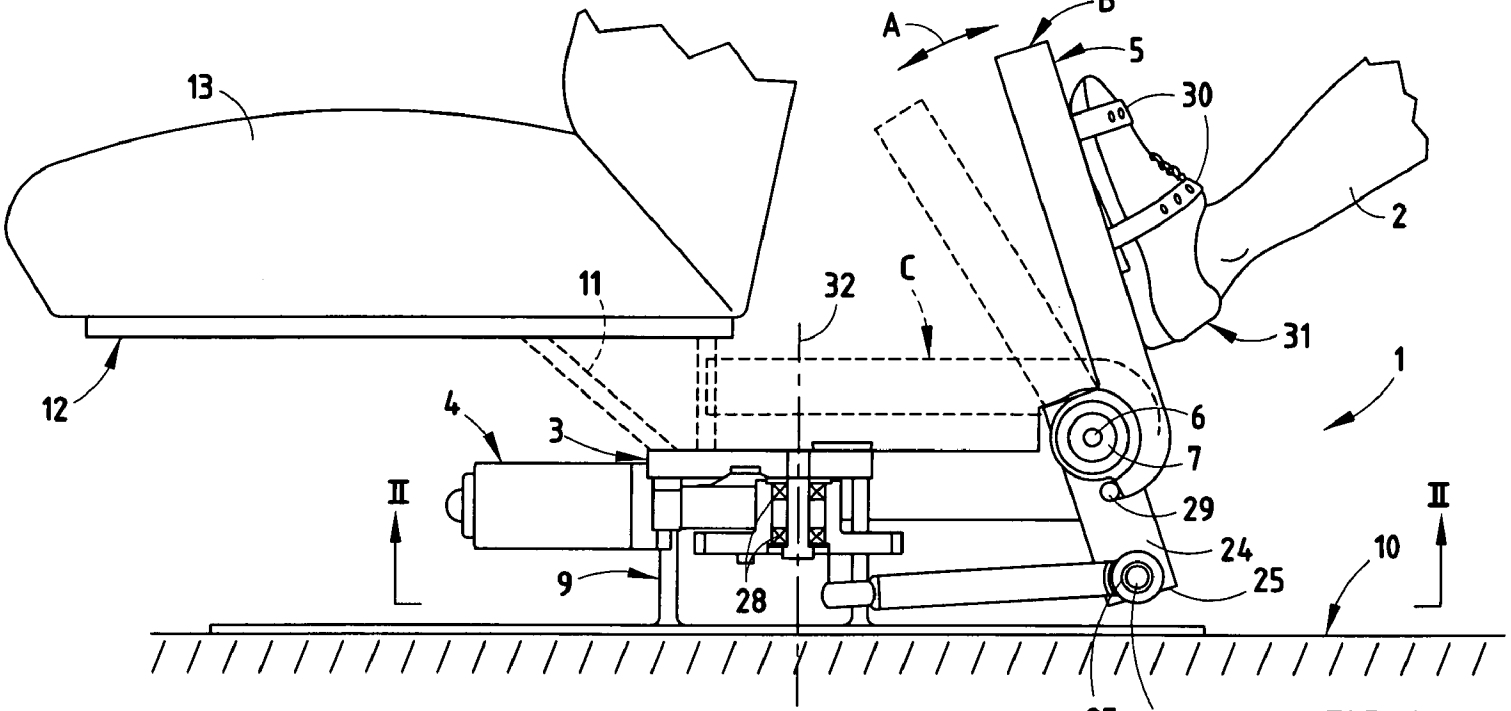
FIG. 1 is a partially fragmentary side view of an exercise device according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates an exercise device for exercising the lower legs 2 of a seated airline passenger. The exercise device 1 includes a support structure 3, and an electric motor 4 secured to the support structure 3. A foot support member 5 is movably mounted to the support structure 3, and the foot support member 5 is operably connected to the motor 4, such that the foot support member 5 reciprocates as indicated by arrow "A" about pivot axis 6 formed by bearing 7 upon actuation of the electric motor 4.

The support structure 3 may include a base 9 configured to support the exercise device 1 on the floor surface 10 of an airline or the like. Alternately, the support structure 3 may include a bracket 11 to secure the exercise device 1 to a structure 12 of a seat 13. It will be readily understood that the exercise device 1 may also be utilized for purposes other than airline travel, such as extended travel in a bus or other vehicle. Still further, the exercise device 1 may be utilized in a wide variety of situations wherein an individual is unable to move his or her legs for an extended length of time.

Figure 2:
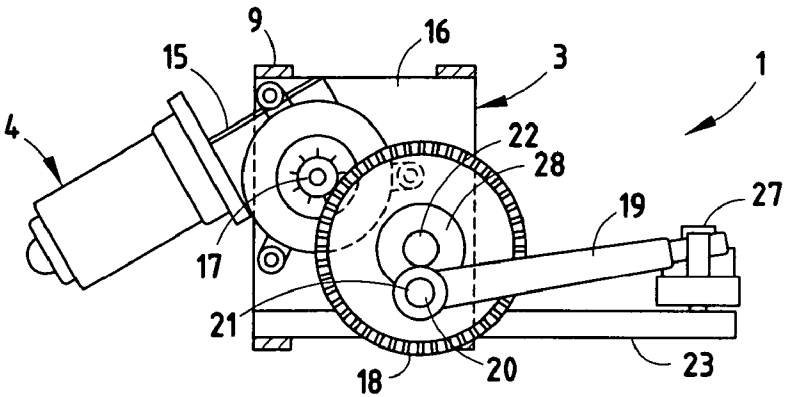
FIG. 2 is a view of the exercise device of FIG. 1 taken along the line II—II.

With further reference to FIG. 2, support structure 3 includes a bracket 15 securing the electric motor 4 to a plate 16. A first gear 17 drives a larger second gear 18. Second gear 18 is rotatably mounted to the plate 16 via bearings 28 for rotation about a vertical axis 32. Second gear 18 is connected to a link 19 via a ball joint 20 at a pivot point 21 that is spaced-apart from the axis of rotation 22 of second gear 18. Support structure 3 further includes a support member 23 extending from plate 16. Foot support member 5 includes a lower extension 24, and link 19 is connected to a lower end 25 of extension 24 at pivot 26 formed by a ball joint 27. A releasable connector such as a pin 29 or the like can be utilized to secure the foot support member 5 in a generally upright, use position designated "B" in FIG. 1. The pin 29 can be released relative to the extension 24 to permit rotation of the foot support member 5 to a storage position "C". When the foot support member 5 is in the storage position C, the exercise device 1 can be stored underneath a seat 13.

Support platform 5 preferably includes straps 30 to releasably retain a user's foot 31 to the foot support member 5. In a preferred embodiment, the straps 30 are elastic straps. Also, a single elastic strap 30 may be provided for each foot to facilitate quick and easy securing and releasing of the user's feet. However, other suitable straps having buckles or the like could also be utilized.

In use, the passenger places his or her feet on the foot support member 5, and secures them with straps 30. The electric motor 4 is then actuated, causing the foot support platform to reciprocate about the pivot axis 6. The reciprocation of foot support member 5 is due to the action of the crank formed by the link 19 and second gear 18, as well as the extension 24 of foot support member 5 that extends below the axis 6. The orientation of the second gear 18 in a generally horizontal plane permits a low profile design, thereby permitting storage of the exercise device 1 under the seat 13 while still providing the necessary gear reduction. The rotational speed of electric motor 4 may be adjusted to provide the desired frequency of reciprocation of foot support member 5. Also, the position of pivot 21 relative to axis 22 may be adjusted to provide for more or less travel of foot support member 5. Still further, the pin 29 may engage a selected one of a plurality of openings (not shown) arranged in an arc about pivot 6 in foot support member 5 to vary the angle of foot support member 5 if required for a particular application.

Use of the exercise device 1 during long-haul airline flights, vehicle trips, or the like provides exercise for the lower leg muscles, providing prophylaxis by mechanical means. The foot support member flexes both ankles simultaneously, stretching calf and anterior tibial muscles alternately. This exercise prevents blood stasis of the lower leg by using the calf and tibial muscles (the so-called peripheral venous pump). It will be readily appreciated that the exercise device 1 of the present invention may be used in a wide variety of situations wherein a person is seated or otherwise not mobile for extended periods of time.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An exercise device for exercising the lower legs of airline passengers, comprising:

a support structure;

an electrical motor secured to the support structure, and including a rotating output member comprising a first gear;

a foot support member movably mounted to the support structure, the foot support member operably connected to the motor such that the foot support member reciprocates upon actuation of the motor;

and including:

a crank interconnecting the rotating output member to the foot support member and turning the rotary motion of the rotating output member into reciprocating motion driving the foot support member;

the crank including a second gear defining a rotational axis and meshing with the first gear, the crank further including a link having a first end connected to the second gear at a location spaced from the rotational axis, and having a second end connected to the foot support member; wherein the second gear is oriented in a generally horizontal plane and the rotational axis of the second gear is substantially vertical relative to said generally horizontal plane; and the foot support member pivots about a substantially horizontal axis upon actuation of the motor.

2. The exercise device of claim 1, wherein:

the first and second ends of the link include ball joints interconnecting the link to the second gear and the foot support member.

3. An exercise device for exercising the lower legs of a seated person, comprising:

a support structure;

a foot support member pivotably mounted to the support structure for reciprocating movement between first and second positions, the foot support member having a releasable connector that permits rotation of the foot support member beyond said second position to a storage position when the connector is released;

a motor mounted to the support structure and coupled to the foot support member and providing powered reciprocating movement of the foot support member;

the motor includes a rotating output member; and including:

a crank interconnecting the rotating output member to the foot support member and turning the rotary motion of the rotating output member into reciprocating motion driving the foot support member;

the motor comprises an electrical motor, and the rotating output member comprises a first gear;

the crank including a second gear defining a rotational axis and meshing with the first gear, the crank further including a link having a first end connected to the second gear at a location spaced from the rotational axis, and having a second end connected to the foot support member; wherein the second gear is oriented in a generally horizontal plane and the rotational axis of the second gear is substantially vertical relative to said generally horizontal plane;

the foot support member includes restraints configured to hold the feet of a user; and the foot support member pivots about a substantially horizontal axis upon actuation of the motor.

4. The exercise device of claim 3, wherein:

the first and second ends of the link include ball joints interconnecting the link to the second gear and the foot support member.

5. The exercise device of claim 4, wherein;

the support structure comprises a bracket configured to secure the exercise device to a seat structure.

6. The exercise device of claim 4, wherein:

the support structure comprises a base configured to support the exercise device on a generally horizontal surface.

* * * * *